United States Patent [19]

Ting et al.

[11] Patent Number: 4,473,729

[45] Date of Patent: Sep. 25, 1984

[54] PRESSURE RESPONSIVE SWITCH

[75] Inventors: Youn H. Ting; Stanley F. Kummer; Werner Strasser, all of Lexington, Ky.

[73] Assignee: Texas Instruments Incorporated, Dallas, Tex.

[21] Appl. No.: 391,053

[22] Filed: Jun. 22, 1982

[51] Int. Cl.[3] ..... H01H 35/34

[52] U.S. Cl. ..... 200/83 Z; 200/83 B; 200/83 J; 200/83 P; 200/83 A

[58] Field of Search ..... 200/83 R, 83 W, 83 Y, 200/83 P, 83 A, 83 B, 83 Z, 83 J

[56] References Cited

U.S. PATENT DOCUMENTS

| | | | |
|---|---|---|---|
| 2,230,770 | 2/1941 | Van Almelo | 200/83 Z |
| 2,331,826 | 10/1943 | Davenport | 200/83 Z |
| 3,052,777 | 9/1962 | Meisenheimer, Jr. et al. | 200/83 J |
| 3,436,503 | 4/1969 | Moody | 200/83 Z |
| 3,584,168 | 6/1971 | Halpert et al. | 200/83 R |
| 3,781,744 | 12/1973 | Olson | 200/83 Z |

*Primary Examiner*—J. R. Scott

*Attorney, Agent, or Firm*—James P. McAndrews; John A. Haug; Melvin Sharp

[57] ABSTRACT

A sealed pressure-responsive switch is manually resettable and trip-free. The switch has a separate snap-acting, bistable, dished metal disc or disc element disposed between a sealed snap-acting pressure-responsive diaphragm and a spring-biased switch arm. The disc moves to an inverted dished configuration with snap action to move the switch arm to a trip position against the arm bias when the diaphragm moves in response to application of a selected fluid pressure. The disc remains in its inverted shape to releasably hold the arm in tripped position until the switch is manually reset even when the diaphragm returns to its original position after removal of the selected fluid pressure from the diaphragm. A push button or push button means is selectively movable to apply a force to the disc sufficient to restore the disc to its original disc configuration after the fluid pressure is removed from the diaphragm, thereby to permit the switch arm to reset in response to its spring bias and provide trip-free manual reset switch operation.

12 Claims, 3 Drawing Figures

PRESSURE RESPONSIVE SWITCH

BACKGROUND OF THE INVENTION

This invention relates to a pressure responsive control device for use in a compressor or the like to perform a control function in response to the occurrence of a selected fluid pressure. The invention relates more particularly to a sealed, pressure-responsive electrical switch which is manually resettable and trip-free.

In one known pressure-responsive switch, a diaphragm which is not hermetically sealed is spring mounted to move progressively in response to increase in fluid pressure applied to the diaphragm. A motion transfer pin transmits diaphragm movement to a switch arm which is initially disposed in one control position. The switch arm has a snap-acting portion adapted to trip and move the arm to a second control position when the motion transfer pin applies sufficient force to the arm. The diaphragm thus serves to move the switch arm to perform a control function in response to the occurrence of a selected fluid pressure. Spring-loaded push button means are arranged to apply a counteracting force to the switch arm when desired so that, after the applied fluid pressure has fallen below the selected level, the push button means can be selectively depressed to restore the switch arm to its first control position. The switch is thus manually resettable and an abnormal condition causing an overpressure condition or the like to occur can be corrected before the switch is reset. However, it is found that, in that known switch, a portion of the force applied by the push button means is transmitted to the diaphragm. As a result, the switch operation is not trip-free and, if the push button is held depressed, the switch is adapted to trip only at a different fluid pressure level.

Another well known pressure-responsive switch is characterized by its hermetically-sealed construction. In that switch, a switch arm is spring biased so that it is normally disposed in a first switch position. A diaphragm has a welded flange mounting the diaphragm in sealed relation in the switch and has a domed central portion which is movable from an original dished configuration to an inverted dished configuration with snap action when a selected fluid pressure is applied to the diaphragm. The diaphragm movement is transmitted to the switch arm through a motion transfer pin so that, when the diaphragm moves with snap action in response to application of the selected pressure, the switch arm is moved sharply to a tripped position. The diaphragm snaps back to its original dished configuration when the selected fluid pressure is removed permitting the switch arm to return automatically to its original position in response to the arm bias to reset the switch. For many applications it would be desirable if such a sealed switch could be manually resettable to permit correction of overpressure conditions or the like before resetting is permitted. It would also be desirable if such a sealed, manually resettable pressure switch could achieve trip-free operation.

SUMMARY OF THE INVENTION

It is an object of this invention to provide a novel and improved pressure-responsive control device; to provide such a device which is rugged, inexpensive and hermetically-sealed; and to provide such a device which is manually resettable. It is a particular object of this invention to provide an hermetically-sealed, manually-resettable pressure-responsive electrical switch which is trip-free in operation.

Briefly described, the novel and improved pressure-responsive device of this invention comprises a switch or control arm which is movable between first and second control positions and which is preferably biased with selected force to move to the first control position of the switch arm. Preferably, the switch arm is normally disposed in a closed circuit position holding switch contacts engaged but the arm is movable to an open circuit, tripped position where the contacts are disengaged. A diaphragm incorporated in the switch is movable from a first to a second diaphragm position preferably with snap action in response to application of a selected fluid pressure to the diaphragm. The diaphragm returns to the first diaphragm position with snap action when application of the selected fluid pressure is removed. Preferably, separate latching means such as a dished disc or disc element is disposed between the diaphragm and the switch arm to be moved with snap action from an original dished configuration to an inverted dished configuration by movement of the diaphragm to the second diaphragm position. The disc or disc element is located so that the disc movement to its inverted shape moves the switch arm to the second or tripped position of the arm against the spring bias of the arm. The disc element then remains in its inverted dished configuration to releasably hold the switch arm in tripped position against the bias force of the arm. A reset means such as a push button means is selectively movable to apply sufficient additional force to move the dished disc or disc element back to its original dished configuration and permit return of the switch arm to its original control position in response to the bias force on the switch arm when the selected fluid pressure has been removed and the diaphragm has returned to its original position.

In a preferred embodiment, the switch has a cover with an aperture or cover opening for communicating with a fluid pressure zone. The diaphragm has its periphery welded in sealed relation to the periphery of the cover and has a domed central portion which moves the snap action between first and second domed diaphragm positions in response to application and removal of the selected fluid pressure to the diaphragm through the cover aperture. A support having a central opening is secured to the diaphragm periphery opposite from the cover to engage the domed portion of the diaphragm when it is in the second diaphragm position to support the diaphragm against over pressure conditions or the like which may occur. A switch body means is mounted on the support, a guide having an opening is mounted on the switch body means, a motion transfer pin is slidably movable in the guide opening, and a resilient switch arm is mounted on the switch body means to be movable between first and second circuit positions, the switch arm being normally biased to its first circuit position. The guide has a recess aligned with the noted guide opening and is mounted adjacent to the support so the recess cooperates with the support to form a chamber. The disc element has rivet means or the like mounted thereon and is disposed in the chamber between the guide and support for locating the disc element so the rivet means extends into the support opening to be engaged during snap acting movement of the diaphragm to move the disc as above described. The reset means preferably comprise a push button means resiliently mounted for limited movement on the switch body means to press the switch arm against the dished disc element with a limited, additional force to restore the dished element to its original dished configuration without transmitting that force to the diaphragm after application of the selected fluid pressure is removed from the diaphragm and the diaphragm has returned to its original diaphragm position. Preferably, protuberances are provided on the support for cooperating with bottom and side walls of the guide recess in locating the disc relative to the switch diaphragm for precisely predetermining the switch actuating pressure. Preferably, the switch body means includes mounting flange means for use in permitting mounting of the switch on one side of a control panel while locating the reset means to be accessible from an opposite side of the control panel.

DESCRIPTION OF THE DRAWINGS

Other objects, advantages and details of the novel and improved pressure responsive device of this invention appear in the following detailed description of the device, the detailed description referring to the drawings in which.

DESCRIPTION OF THE PREFERRED EMBODIMENTS

Figure 1:
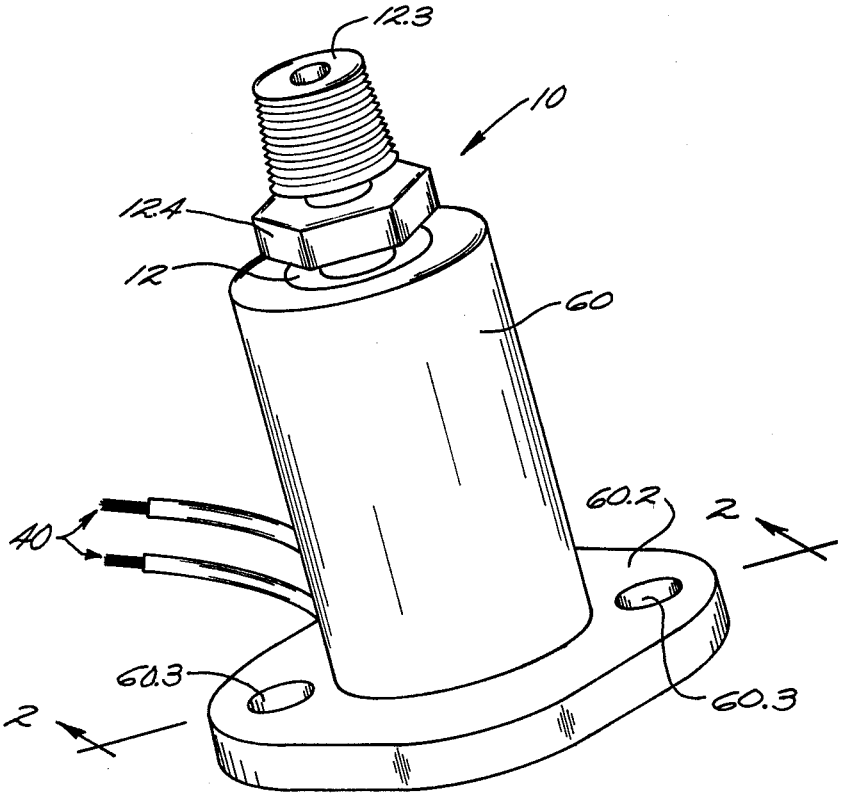
FIG. 1 is a perspective view of the novel and improved pressure responsive device of this invention.
Figure 2:
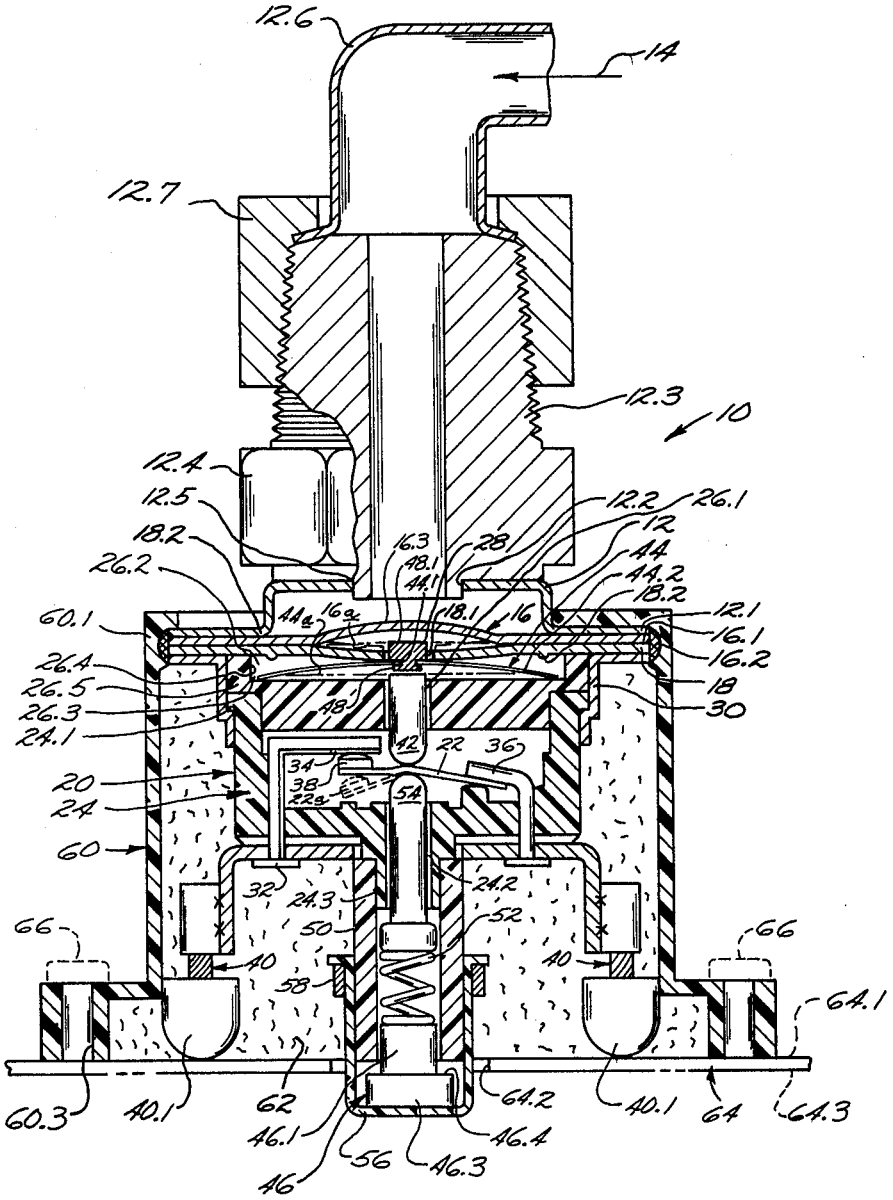
FIG. 2 is a section view to enlarged scale along line 2—2 on the longitudinal axis of the device of FIG. 1.

Referring to the drawings, the novel and improved pressure-responsive device 10 of this invention includes a cover or cover member 12 having a periphery 12.1 and having an opening or aperture 12.2 for communicating with a fluid pressure zone. The cover is cup-shaped and a threaded nipple 12.3 with an hexagonal part 12.4 is secured by brazing or the like to the cover at 12.5. The nipple is easily connected to a tube 12.6 by a coupling 12.7 in a conventional manner for remotely connecting the cover opening 12.2 to an applied fluid pressure as is diagrammatically illustrated by the arrow 14 in FIG. 2. Alternately, the nipple is adapted to be threaded into a bushing in a wall of a pressure vessel for directly connecting the cover opening 12.2 to a pressure zone inside the vessel as will be understood.

Figure 3:
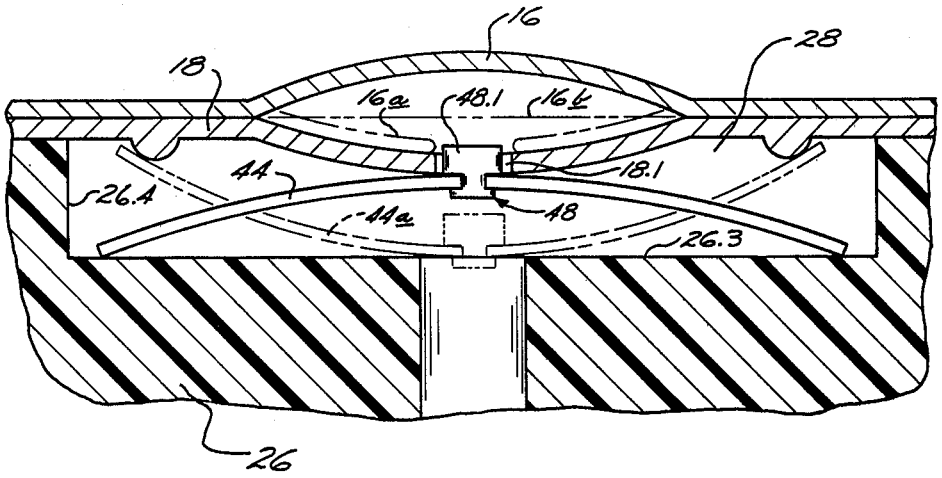
FIG. 3 is a partial diagrammatic view similar to FIG. 2 to further enlarged scale illustrating operation of the device.

A pressure-responsive diaphragm 16 is mounted on the cover 12 to be exposed to the fluid pressure 14 through the cover opening. Preferably, the diaphragm is formed of stainless steel, has a peripheral flange 16.1 welded or otherwise secured in hermetically sealed relation to the periphery 12.1 of the cover as indicated at 16.2, and has a domed central portion 16.3 which moves with snap action from the first diaphragm position illustrated in solid lines in FIGS. 2 and 3 to the second diaphragm position indicated by the broken lines **16*a* when a predetermined, selected level of fluid pressure 14 is applied to the diaphragm. Preferably, the diaphragm is adapted to return to its original diaphragm position with snap action after that selected level of fluid pressure has been removed from the diaphragm. Typically, for example, the diaphragm is adapted to remain in its original position as applied fluid pressure 14 increases to a first, set or actuation pressure characteristic of the diaphragm. The diaphragm then moves through an over-center position diagrammatically illustrated in FIG. 3 by the broken lines 16*b* and proceeds with snap action to the second diaphragm position indicated by broken lines 16*a*. The diaphragm remains in that second diaphragm position until the applied fluid pressure 14 falls to a second, relatively lower level a predetermined degree below the set or actuation pressure of the diaphragm. At that second or differential fluid pressure level, the diaphragm then returns back through the over center position 16*b* with snap action to the original, solid-line position of the diaphragm. Typically, the diaphragm 16** incorporates several stainless steel diaphragm elements (not shown) which are arranged in nested relation to act as a unit and which cooperate to provide the diaphragm with desired, predetermined actuation and differential or restoration pressure characteristics in conventional manner.

A support 18 such as an annular metal ring having a central opening 18.1 preferably secured to the diaphragm periphery 16.1 by the welding 16.2 or the like opposite from the cover 12 so that the support engages the domed portion of the diaphragm when the diaphragm is in its second position **16*a*** for supporting the diaphragm against over pressure conditions and the like which may occur.

The device 10 also includes a switch body means 20 which is mounted relative to the support 18 in any conventional manner. A switch arm 22 is mounted on the switch body means to be movable between first and second switch or control positions and the switch arm is biased to move with a selected force to one of the control positions. Preferably, for example, the switch body means includes a generally cup-shaped body 24 of a strong, rugged phenolic, electrical insulating material or the like. A guide 26 with a central opening 26.1 has a recess 26.2 with a bottom 26.3 and a side wall 26.4 and is nested in the open end of the cup-shaped switch body next to the support 18 so that the guide recess cooperates with the support to form a chamber 28. The switch body and guide have flanges 24.1 and 26.5 and a metal sleeve or ring 30 is welded as at 16.2 to the support 18 and is swaged around and over the switch body and guide flanges for securing the guide and the switch body to the support. A terminal 32 is mounted in an aperture in the switch body by press-fitting or the like and a fixed contact 34 is mounted on the terminal inside the switch body. Another terminal 36 is mounted on the switch body in a similar manner and the switch arm 22 is mounted at one end on the terminal 36 and carries a movable contact 38 at its opposite end. Leads 40 with insulation 40.1 thereon are connected to the terminals to extend from the device 10 in conventional manner. The switch arm 22 is normally biased by its inherent spring characteristics to move with a selected force into the first, contacts-engaged position shown in solid lines in FIG. 2 for closing a circuit between the leads 40. However, the switch arm is adapted to be moved to the second, tripped or open circuit position indicated by the broken lines **22*a* in FIG. 2 against the bias of the spring force of the arm as will be understood. A motion transfer pin 42**, typically of a dimensionally stable ceramic material or the like is mounted for sliding movement in the guide opening.

In accordance with this invention, a separate, snap-acting, bistable, dished disc or disc element 44 of stainless steel or the like is disposed in the device 10 between the diaphragm 16 and the switch arm 22. The disc element is movable with snap action from a first or original dished configuration to a second or inverted dished configuration when the diaphragm 16 moves in response to application of the selected fluid pressure 14 as above described. That is, the disc element is movable with snap action from an original dished configuration as shown in solid lines in FIG. 2 to an inverted dished configuration as is partially illustrated in FIG. 2 by the broken lines 44*a*. The disc is arranged so that such movement to its inverted shape moves the switch arm 22 to the tripped arm position against the bias of the switch arm. The disc is bistable and is adapted to remain in its inverted shape to hold the arm 22 in tripped position against the bias of the arm even when the fluid pressure 14 applied to the diaphragm 16 is removed. A manual reset means such as a push button means 46 is mounted in the device 10 to be selectively movable to restore the disc element to its original dished configuration when desired to permit the switch to automatically return to its original position and reset the switch after the pressure 14 is removed from the diaphragm. The dished disc element 44 cooperates with the reset or push button means 46 to isolate the diaphragm 16 from the force applied by the reset means after the selected fluid pressure is removed from the diaphragm, thereby to provide the switch 10 with trip-free pressure responsive operation.

Preferably for example, the disc or disc element 44 has a central opening 44.1 and a rivet 48 or the like is mounted in the disc opening in conventional manner. The disc is disposed in the chamber 28 between the diaphragm 16 and the motion transfer pin 42 so that, when the disc is in its original dished configuration, the rivet 48 extends into the support opening 18.1 to be engaged by the diaphragm 16 during diaphragm movement as above described. In the preferred embodiment, the bottom of the guide recess 26.2 locates the perimeter 44.2 of the disc so that the rivet head 48.1 is located below the over-center line 16*b* of the diaphragm for a purpose to be noted below. The disc is also arranged so that when the disc moves to its inverted dished configuration as illustrated by the broken lines 44*a*, the motion transfer pin 42 moves sharply to move the switch arm 22 to its tripped or open circuit position. Preferably, protuberances 18.2 are formed on the support 18 at spaced locations around the support to cooperate with the guide recess 26.2 in precisely locating the disc 44 relative to the diaphragm 16.

Preferably also the switch body 24 has an opening 24.2 with a sleeve 24.3 formed around the opening. A push button guide sleeve 50 has a press fit or the like on the body sleeve and the push button or push button means 46 has a shank 46.1 which is slidable in the guide sleeve. The push button shank engages a coil spring 52 located in the guide sleeve and a plunger 54 for normally biasing the plunger to extend from the guide sleeve with a selected force. The push button also has a head 46.3 forming a shoulder 46.4 adapted to engage the guide sleeve 50 for limiting axial movement of the push button 46 relative to the guide sleeve. Preferably, a sealing rubber boot 56 is fitted over the push button 46 and is clamped to the guide sleeve 50 by a metal ferrule 58 or the like.

In the preferred embodiment of the invention, a potting cup body part 60 formed of a phenolic material or the like has a ring portion 60.1 fitted over the switch body means 20 and attached by a snap-fit to the peripheries of the cover 12 and securing ring 30 of the sensor portion of the switch 10. The potting cup body part also preferably has a mounting flange portion 60.2 provided with mounting holes 60.3. The interior of the potting cup body part is then molded full of a conventional epoxy potting compound indicated by stippling 62 or the like for sealing and securing the potting cup body part, the push button means including the guide sleeve 50 and the boot 56, and the switch body means 20 in assembled relation to each other. As thus assembled, the switch 10 is adapted to be mounted on a control panel diagrammatically indicated at 64 in FIG. 2 by mounting screws 66 so that the switch is located at one side 64.1 of the panel while the push button means 46 with its sealing boot 56 extends through a panel opening 64.2 to be accessible from the opposite side 64.3 of the panel. In that arrangement, the mounting flange part 60.2 of the potting cup body part preferably has openings (not shown) permitting the device leads 40 to extend laterally away from the device behind the panel 64 as will be understood.

In the preferred embodiment, of the pressure responsive switch 10 as thus described, the switch arm 22 is normally in closed circuit position when the applied pressure 14 is below the level of the set or actuation pressure of the switch as determined by the characteristics of the diaphragm 16. However, if the pressure 14 increases to the actuation pressure level of the switch, the diaphragm moves to its second position 16*a* with snap action to strike the rivet head 48.1 on the disc element 44 and move the disc to its inverted configuration and to transmit that disc movement through the pin 42 to the switch arm 22 to sharply trip the arm to its tripped or open circuit position. The switch 10 is therefore adapted to perform its control function in response to the occurrence of the device actuation pressure. The disc 44 is bistable and, accordingly, remains in its inverted dished configuration to releasably hold the switch arm 22 in tripped position against the arm bias.

When the applied fluid pressure 14 subsequently falls below the actuation pressure of the switch to the relatively lower differential or restoration pressure of the switch, the diaphragm 16 moves with snap action back to its original domed configuration. At that point, the disc element 44 remains inverted and continues to hold the switch arm in tripped position. Then, if the push button means 46 is selectively depressed by manual pressure applied to the boot 56, the push button movement applies an additional resilient force to the disc element 44 through the spring 52, plunger 54 and arm 22 and via the motion transfer pin 42. The movement of the push button 46 is limited by engagement of the button shoulder 46.4 with the guide sleeve 50 so the additional force applied to the element 44 is predetermined and limited but is sufficient to move the disc element 44 to return with snap action to its original dished configuration, thereby permitting the switch arm 22 to return to closed circuit position and reset the switch in response to the spring bias of the switch arm. If the push button or push button means 46 is depressed before the diaphragm 16 has moved with snap action back to its original domed configuration, the diaphragm resists restoration of the disc element to its original dished configuration and the limited force applied by the push button is normally insufficient to effect resetting of the switch.

Typically for example, the diaphragm 16 moves to trip the switch when the applied fluid pressure 14 is 400 psi. and there is a force of about 100 pounds applied to the diaphragm. The diaphragm then remains in its over-center position until the applied pressure 14 reduces to about 300 psi. and the force applied to the diaphragm is reduced to about 75 pounds. As the diaphragm moves through the overcenter position 16*b* in tripping the switch, the force applied to the disc 44 is more than sufficient to drive the disc to its inverted configuration and trip the switch arm against its bias and the disc easily holds the arm firmly in its tripped position. The push button 46 is adapted to apply a force of a few pounds to the switch arm 22 which is sufficient to restore the disc to its original dished shape under bias of the arm 22 when the diaphragm 16 is returned to its original position but which is not normally significant to cause resetting of the switch when the diaphragm 16 is in its second or tripped position. Most important, when the diaphragm 16 is in its original domed configuration and the switch arm 22 is reset in its original position by movement of the push button 46, holding of the push button in depressed condition does not alter the actuation pressure of the switch so that manual resetting operation of the switch is achieved while also providing trip-free switch operation.

It should be understood that a preferred embodiment of the pressure responsive switch of this invention has been described by way of illustrating the invention. However, many modifications can be made in the illustrative embodiment within the scope of this invention. For example, the diaphragm 16 could be bistable to incorporate functions of the latching disc 44 therein the diaphragm 16 could be adapted for creep rather than snap acting movement; and the latching disc 44 could be secured more positively to the support 18 by welding or the like. It should be understood that this invention includes all modifications and equivalents of the disclosed switch embodiments which fall within the scope of the appended claims.

We claim:

1. In a pressure responsive control device having a control arm movable between first and second control positions, the control arm being biased to move to the first control position, and having diaphragm means movable in response to applied fluid pressure, separate dished disc means having motion transfer means movable therewith, the dished disc means being movable with snap action from an original dished configuration to an inverted dished configuration by movement of the diaphragm in response to application of said fluid pressure to move the motion transfer means to move the control arm from the first to the second control position and to remain in said inverted dished configuration for releasably holding the control arm in said second control position against said bias, and reset means selectively movable to restore the separate dished disc means to said original dished configuration and permit return of the control arm to the first control position in response to said bias when application of said fluid pressure to the diaphragm means is removed.

2. A manually resettable pressure responsive switch comprising a switch arm which is movable between first and second circuit positions and which is biased with a selected force to move toward the first circuit position, a diaphragm movable from a first to a second diaphragm position with snap action in response to application of a selected fluid pressure to the diaphragm and to return to the first diaphragm position with snap action when application of the selected fluid pressure is removed, dished disc means and motion transfer means disposed between the diaphragm and the switch arm, the dished disc means being adapted to be moved with snap action from an original dished configuration to an inverted dished configuration by movement of the diaphragm to the second diaphragm position to move the motion transfer means to move the switch arm from the first to the second circuit position, the dished disc means being adapted to remain in said inverted dished configuration to releasably hold the switch arm in the second circuit position against said bias force, and reset means manually movable to move the switch arm to apply additional force to the dished disc means to move the dished disc means from said inverted dished configuration to said original dished configuration with snap action and permit return of the switch arm to the first circuit position in response to said bias force when the diaphragm returns to the first diaphragm position.

3. A pressure responsive switch comprising a cover having a periphery and having an aperture for communicating with a fluid pressure zone, a diaphragm having its periphery secured in sealed relation to the cover periphery, the diaphragm having a portion which moves from a first to a second diaphragm position with snap action in response to application of a selected fluid pressure to the diaphragm through the cover aperture and which returns to the first diaphragm position with snap action when the selected fluid pressure is removed, a support secured to the diaphragm periphery to engage and support the movable diaphragm portion in said second diaphragm position, a switch body means mounted on the support, a switch arm mounted on the body means to be movable between first and second circuit positions and to be biased to move to said first circuit position, motion transfer means movably mounted on the body means between the diaphragm and the switch arm, a dished disc element disposed between the diaphragm and the motion transfer means to be moved with snap action from an original dished configuration to an inverted dished configuration by movement of the diaphragm to said second diaphragm position to move the motion transfer means to move the switch arm to said second circuit position and to remain in said inverted dished configuration for releasably holding the switch arm in the second circuit position against said bias, and push button reset means mounted for selective manual movement on the body means to move the switch arm with sufficient force to restore the dished disc element to its original dished configuration with snap action and permit return of the switch arm to said first circuit position in response to said bias when the diaphragm returns to the first diaphragm position after removal of said selected fluid pressure.

4. A pressure responsive device as set forth in claim 3 wherein the support has an opening therein and the dished disc element has means mounted thereon extending through the support opening to be engaged by movement of the diaphragm to the second diaphragm position for moving the element to its inverted dished configuration.

5. A pressure responsive device as set forth in claim 4 wherein the dished disc element has an opening therein and the extending means comprises a rivet mounted in the element opening to extend into the support opening.

6. A pressure responsive device as set forth in claim 3 wherein the motion transfer means comprises a pin and the switch body means has a guide with an opening therein slidably receiving the pin for axial movement between the dished disc element and the switch arm, the guide having a recess with a bottom and side walls aligned with the guide opening receiving and positioning the dished disc elment relative to the diaphragm to be moved by movement of the diaphragm.

7. A pressure responsive device as set forth in claim 6 wherein the support comprises an angular ring welded to the periphery of the diaphragm and has proturberances formed therein to cooperate with the guide recess bottom and side walls for positioning a peripheral portion of the dished disc element in the guide recess so that the element is movable between said original and inverted dished configurations by application of predetermined force to the element.

8. A pressure responsive device as set forth in claim 3 wherein the switch body means has flange means thereon for mounting the device on one side of a control panel and push button means extend through the flange means to be received in an opening in the control panel to be accessible from an opposite side of the panel for resetting the device.

9. A manually resettable, trip-free, pressure-responsive control device comprising a control arm movable between first and second control positions, the arm being biased to the first control position, diaphragm means movable in response to applied fluid pressure, motion transfer means, and separate dished disc means to be moved with snap action from an original dished configuration to an inverted dished configuration by movement of the diaphragm means in response to application of said fluid pressure to move the control arm through the motion transfer means from the first to the second control position, the separate dished disc means being adapted to remain in said inverted dished configuration to releasably hold the control arm in the second control position and to be selectively movable by a manually applied force to return to said original dished configuration with snap action and permit the control arm to return to the first control position in response to said bias when said fluid pressure is removed from the diaphragm means without permitting transmission of said manually applied force to the diaphragm means to oppose subsequent movement of the diaphragm means in response to applied fluid pressure.

10. A manually resettable, trip-free, pressure-responsive switch having diaphragm means movable with snap action from a first to a second diaphragm position in response to application of a selected fluid pressure and to return to the first diaphragm position with snap action when said selected fluid pressure is removed, a switch arm movable from a first to a second switch position in response to movement of the diaphragm means to the second diaphragm position, the switch arm being biased to move to the first switch position, separate dished disc means having motion transfer means moveable therewith disposed between the diaphragm means and switch arm to be moved with snap action from an original dished configuration to an inverted dished configuration by movement of the diaphragm means to the second diaphragm position to move the motion transfer means to move the switch arm to the second switch position and to remain in said inverted dished configuration to releasably hold the swith arm in the second switch position against said bias, and reset means resiliently mounted on the device to be selectively movable to apply a sufficient resilient force to return the separate dished disc means to said original dished configuration and permit the switch arm to return to the first switch position in response to said bias without permitting transmission of said resilient force to the diaphragm means to oppose subsequent movement of the diaphragm means in response to said applied fluid pressure.

11. A sealed manually resettable, trip-free, pressure-responsive switch comprising a cover having a periphery and having an aperture communicating with a fluid pressure zone, a diaphragm having its periphery secured in sealed relation to the cover periphery and having a portion which moves with snap action from a first to a second diaphragm position in response to application of a selected fluid pressure through the cover aperture and returns to the first diaphragm position with snap action when said selected fluid pressure is removed, a support having an opening therein secured to the diaphragm periphery to engage and support the movable diaphragm portion in the second diaphragm position, a switch body mounted on the support, a switch arm mounted on the body to be movable from a first to a second switch position in response to movement of the diaphragm to the second diaphragm position, the arm being biased to move to the first switch position, motion transfer means movable mounted on the body between the diaphragm and arm, separate dished disc means disposed between the diaphragm means and the motion transfer means and having means extending into the support opening to be moved with snap action from an original dished configuration to an inverted dished configuration by movement of the diaphragm to the second diaphragm position and transmit force via the motion transfer means to move the switch arm to the second switch position and to remain in said inverted dished configuration to releasably hold the switch arm in the second switch position against the arm bias, a push button slidably mounted on the body to be selectively movable, spring means disposed between the push button means and the switch arm to apply a selected resilient force to the arm in response to selective movement of the push button to return the disc means to said original dished configuration with snap action and permit the contact arm to return to the first control position in response to said bias when the diaphragm has returned to the first diaphragm position without permitting transmission of said resilient force to the diaphragm means to oppose subsequent movement of the diaphragm means in response to said selected fluid pressure.

12. A sealed pressure responsive switch as set forth in claim 11 wherein the push button extends from the switch body oppositely of the motion transfer means, a sealing rubber boot means is fitted over the push button, a potting cup is mounted over the switch body to provide a switch mounting flange, the flange having an opening fitted around the push button permitting the push button and boot to extend through the flange, and a potting compound is disposed in the cup sealingly securing the push button in the potting cup while permitting manual movement of the push button through the flange after mounting of the switch by means of the flange.

* * * * *